US005244267A

United States Patent [19]

Fossier, Jr. et al.

[11] Patent Number: 5,244,267

[45] Date of Patent: Sep. 14, 1993

[54] MOBILE EASEL WORKSTATION

[75] Inventors: Ralph L. Fossier, Jr.; Christina F. Fossier, both of Madison, Wis.

[73] Assignee: Decar Corporation, Middleton, Wis.

[21] Appl. No.: 704,808

[22] Filed: May 23, 1991

[51] Int. Cl.[5] ..... A47B 27/00

[52] U.S. Cl. ..... 312/231; 248/460

[58] Field of Search ..... 312/231, 241, 287; 108/38; 248/441.1, 456, 460, 459

[56] References Cited

U.S. PATENT DOCUMENTS

| | | | |
|---|---|---|---|
| 511,585 | 12/1893 | Carter | 248/456 |
| 1,100,983 | 6/1914 | Miles . | |
| 1,899,687 | 2/1933 | Herrmann . | |
| 2,583,532 | 1/1952 | Havens | 312/231 |
| 2,638,397 | 5/1953 | Wykoff | 312/241 |
| 3,455,439 | 7/1969 | Weiner . | |
| 4,047,309 | 9/1977 | Royko . | |
| 4,098,009 | 7/1978 | Flynn . | |
| 4,195,889 | 4/1980 | Coyne . | |
| 4,703,575 | 11/1987 | Diamond | 40/621 |
| 4,856,856 | 8/1989 | Winstone . | |
| 4,982,683 | 1/1991 | Earnest | 40/586 |

OTHER PUBLICATIONS

Aviation vol. 44, No. 5 May 1945 p. 174.

Jonti Craft Table Top Easels JON-652; Jonti Craft 1991 Educational Play Equipment Catalog.

Holbrook Early Childhood Art Center HP-636, HP-3173; American Academic Supplies, Inc. 1990 Catalog.

*Primary Examiner*—Kenneth J. Dorner

*Assistant Examiner*—Gerald A. Anderson

*Attorney, Agent, or Firm*—Lathrop & Clark

[57] ABSTRACT

An easel cart has wheels and shelves which are open on two sides. Opposed U-shaped channels extend vertically on each open side and are adapted to receive collapsed easel doors. An easel door is folded into each set of easel door guides when the unit is not being used and in storage. Each easel door has two easel boards connected by a flexible hinge. The easel doors prevent access to the cart interior when stored in the channels and may be removed from the cart to serve as portable easels. Two easel positioning blocks with inclined grooves steady the easels and dispose the easel boards at a desired vertically inclined angle.

15 Claims, 2 Drawing Sheets 104
104
96
103
114
112
24
94
90
96
114
103
112
90
78
108
119
114
106
103
24
78
119
94
108
22
103
79
20
59
112
92
52
26
60
26
110
32
28
32
50
74
26
110
79
70
76
36
40
64
62
20
22
114
42
62
76
66
32
34
60
36
4
52
114
114
30
50
34
24
34

112
114
119
119
32
76
50
24
112
34
30
76
4
34
34

MOBILE EASEL WORKSTATION

FIELD OF THE INVENTION

This invention relates to furniture in general and to furniture providing inclined upright work surfaces in particular.

BACKGROUND OF THE INVENTION

Easels are used for holding paper or canvas in a generally inclined upright position for drawing, painting or other creative work thereon. The upright inclined work surface of the easel enables access to the full work surface by the artist while reducing the risk of smudging or smearing the art medium. In general, easels are large and bulky items which require adequate storage space. Frequently, art painting supplies are kept in a separate cabinet or in other areas. Prior art shows portable easels and containers for storage of artists' supplies, such as fixed cabinets and mobile carts.

Tripod easels with collapsible legs are commonly used in outdoor settings where consistent flat surfaces are unavailable. For fixed location activities, desks with top surfaces which may be pivoted into a vertically inclined position are well known.

Various portable easels for occasional use, such as by art students or children during periodic play or art instruction activities, are also known. One type of portable easel consists of two top hinged planar work surfaces which are assembled in an A-frame configuration on a table or desk top with hinged side members which retain the work surfaces inclined at a desired angle. These portable easels, when not in use, must be stored in horizontal stacks on the floor or on shelving or may be leaned against a wall or cabinet where they may easily be dislodged or accessed without authorization by children. Furthermore, the collapsible hinges can pinch children's fingers.

In the elementary school room or at day care facilities space is at a premium. In these environments, easels are used for only a fraction of each day and must be easily accessible and storable and should not present any possible hazards to children by unsecure storage, such as in tall stacks or leaned against vertical surfaces. Furthermore, it is desirable to associate the portable easels with storage for the various art supplies used in conjunction with the desired artistic activities.

In the day care and school setting, furnishings must be easy to maintain and clean, and must also be safe for children to use. What is needed is a functional unit which combines art supply storage space and easel storage, which is easily assembled and moved, which is stable when used by children, simple to maintain, and which can be used for other purposes when not serving as an easel workstation.

SUMMARY OF THE INVENTION

The mobile easel workstation of this invention has a cart with two spaced side walls with shelves extending between the walls which are open to the front and back. The cart also has locking casters located on the bottom. Two removable easel doors are used to close the two open sides of the cart.

The exterior top and exterior side walls of the cart are made of particle board with a high pressure laminate plastic surface on the exterior facing surfaces.

U-shaped easel guide channels extend vertically along each side wall and form a cavity for receiving an easel.

Each workstation accommodates two portable easels which alternatively serve as doors to block access to the cart interior and shelves. Each easel has two top-hinged boards which, in an opened configuration, may be erected on a table or on the cart top by placing the lower edges of the boards in a pair of easel positioning blocks. These blocks have a ridged, non-slip, bottom surface and two inclined slots to position the boards at the desired inclination. The easel positioning blocks are stored in the cart. When not in use, the easels are stored in the easel guide channels, thereby forming closed sides to the cart.

The easel doors are composed of particle board with high pressure laminate on both sides of the particle board. The easel boards have two generally rectangular surfaces and are joined by a flexible plastic hinge. Handles extend upwardly from the easels and paper fasteners are located on each board.

It is an object of the present invention to provide an easel workstation that stores easels and art supplies in a compact space yet which allows quick access to the supplies and rapid set up of the easels.

It is a further object of the present invention to provide a storage device for art supplies and easels that is mobile and can be moved into and out of art areas as needed and made stationary and stable during easel use and during storage and use with other activities.

It is also an object of the present invention to provide an easel that can be easily assembled for use and disassembled for storage and that requires limited storage space.

It is a still further object of the present invention to provide an easel which has a means for easily grasping the easel to remove it from storage.

It is another object of the present invention to provide a device for storage of art supplies which permits easy access by adults but which deters unauthorized access by small children.

It is yet another object of the present invention to provide a mobile easel workstation which is sturdy and resistant to high impact, marring, scratching and chipping.

It is still yet another object of the present invention to provide an easel formed of particle board having a high pressure laminate surface on each side of the particle board which is durable, sturdy, easy to clean and resistant to high impact, marring, scratching and chipping.

Further objects, features, and advantages of the invention will be apparent from the following detailed description taken in conjunction with the accompanying drawings.

DESCRIPTION OF THE PREFERRED EMBODIMENT

Figures 1, 2:
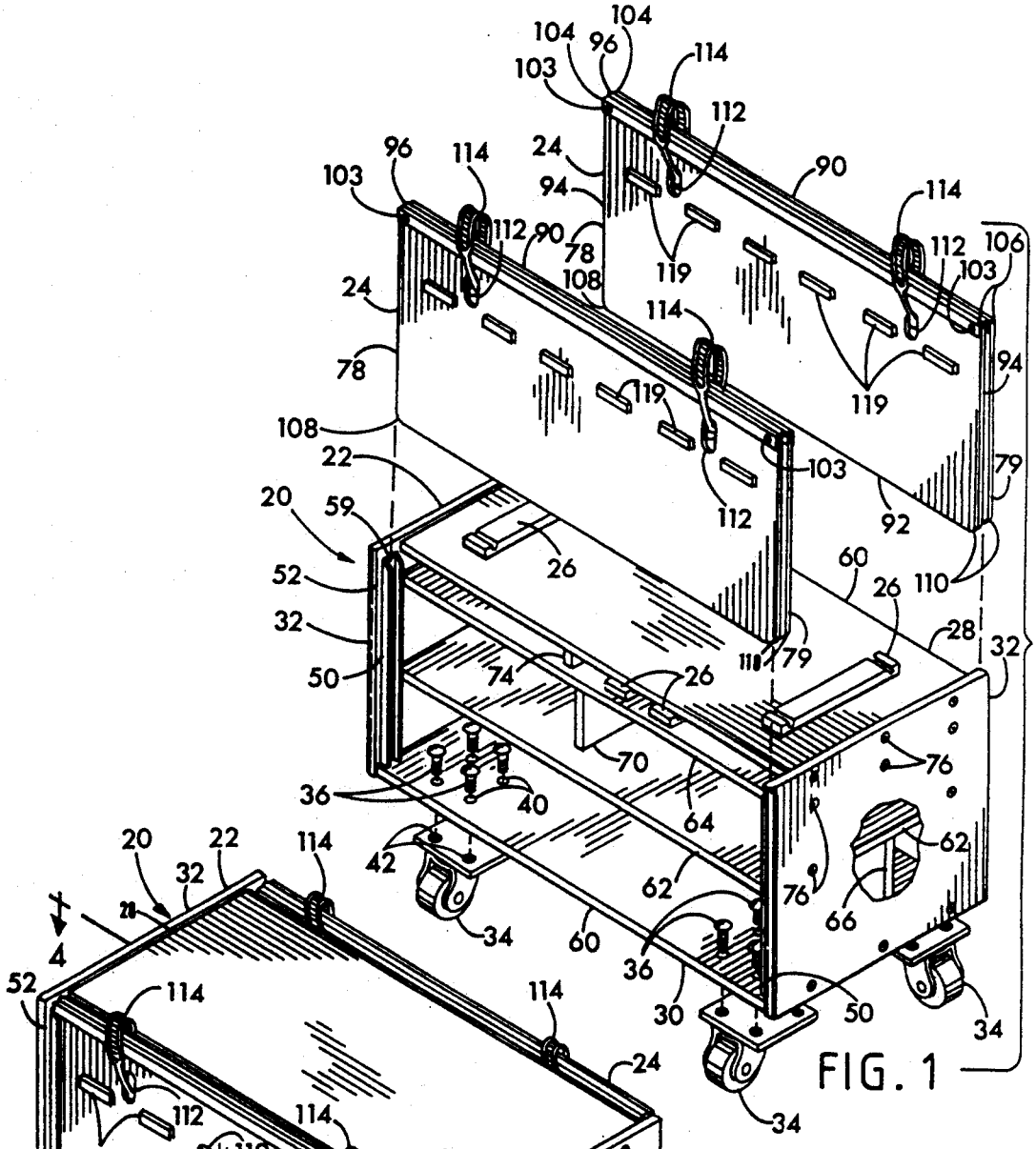
FIG. 1 is an exploded isometric view of the easel workstation of this invention with the easel doors raised.
FIG. 2 is an isometric view of the easel workstation of FIG. 1 with the easel doors in a closed position.

Referring more particularly to FIGS. 1–6 wherein like numbers refer to similar parts, a mobile easel workstation 20 is shown in FIG. 1.

The mobile easel workstation 20 includes an easel cart 22, two easel doors 24 and easel positioning blocks 26. The easel cart 22 is generally rectangular in shape. It has a top 28 and a bottom 30 fastened to two identical side panels 32. The side panels 32 serve as side walls and are opposite one another and parallel to one another. The bottom 30 of the cart 22 has caster wheels 34 located at each corner. The casters 34 are lockable to prevent movement of the cart 22 when the cart is in storage or in use for art activities. Preferably bolts 36 backed by a washer are threaded through bolt openings 40 in the cart bottom 30 and then into openings in the caster 42. A nut is affixed to the end of the bolt 36.

Figure 4:
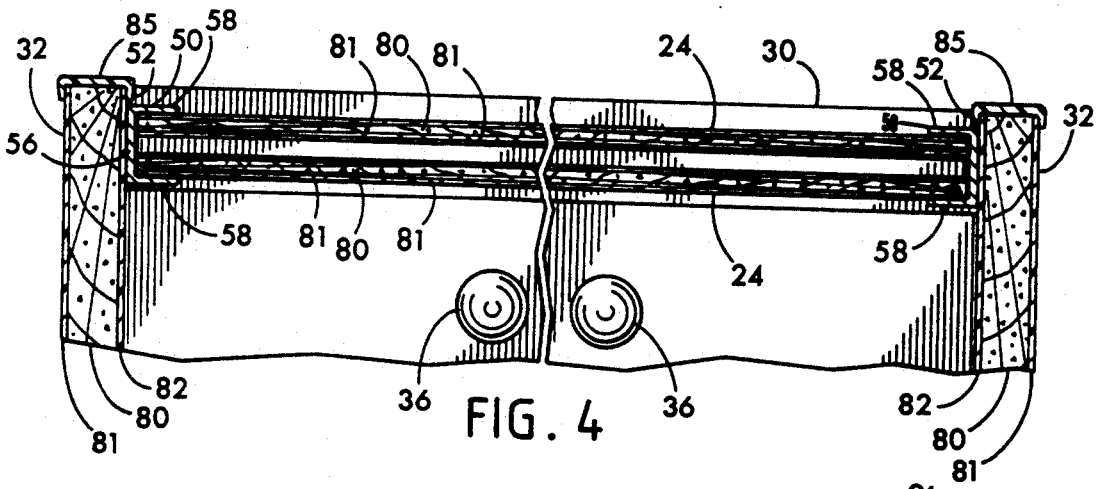
FIG. 4 is across-sectional view of the easel workstation of FIG. 2 taken along section line 4—4.

The top 28 of the cart 22 is smaller in width than the bottom 30 but has the same length. An easel door guide 50 is fastened along each of the inside edges 52 of the cart side panels 32. The guides 50 are positioned perpendicular to and adjacent to the bottom 30 of the cart 22, and are fastened by staples (not shown) to the side panels 32. As best seen in FIGS. 1 and 4, each easel door guide 50 defines a U-shaped channel with the bottom flat portion 56 of the U fastened to the inside edge 52 of the cart 22 and the two side portions 58 of the U projecting perpendicularly and outwardly from the inside edge 52 of the side panel of the cart 22. The top edges 59 of the easel door guide 50 are below the top 28 of the easel cart 22 and are radiused to reduce wear and eliminate sharp edges.

Two easel door guides 50 are located on each of the open sides 60 of the cart 22. The cart 22 has a first shelf 62 and a second shelf 64. The first shelf 62 has substantially the same dimensions as the top 28 of the cart 22 and is spaced from the cart bottom 30 by a longitudinal first brace 66. The first brace 66 is fastened perpendicular to the cart bottom 30, the first shelf 62 and the side panels 32, and separates the cart bottom 30 into two long rectangular compartments. The first brace 66 provides structural stability to the mobile cart.

The second shelf 64 is spaced from and parallel to the first shelf 62 and is of substantially the same dimensions. The second shelf 64 is fastened perpendicular to the side panels 32. A second brace 70 extends between the first and second shelves and divides the volume therebetween into two square compartments. The second shelf 64 is spaced from the cart top 28.

A third brace 74 connects the cart top 28 to the second shelf 64. The third brace 74 extends perpendicularly to the cart top 28 and to the second shelf 64. Art supplies and clean-up supplies may be placed on the shelves and on the bottom 30 of the cart 22. Materials are accessible from either of the two open sides 60 from the first shelf 62 and second shelf 64. The shelves and braces are fastened preferably by screws 76. Alternative shelf and bracing arrangements may be made or shelves and bracing may be omitted.

Figure 6:
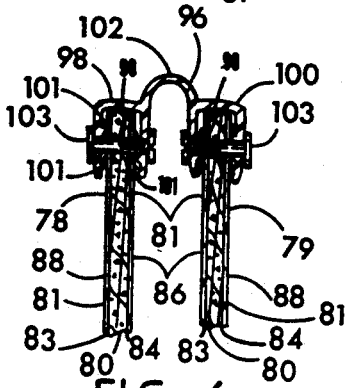
FIG. 6 is a cross-sectional view of the flexible hinge of the easel door of FIG. 3 taken along section line 6—6.

The easel cart 22 and easel doors 24 are preferably fabricated from particle board 80 with a high pressure laminate finish 81 on the exterior surfaces of the side walls 32 and top 28 of the cart and on both surfaces of the easel boards as seen in FIGS. 4 and 6. High pressure laminate is formed by assembling layers of paper which are impregnated with various thermoplastic resins, placing the papers in a press, and then applying heat and pressure. The process produces sheets of laminate. The back of the laminate sheet is sanded for good bonding to the particle board 80 substrate. The particle board is bonded to the laminate sheet. This finish provides strength, durability, attractive appearance and ease of maintenance for the cart. These characteristics are especially important in the demanding conditions of a preschool, day care facility, or other environments where active young children are present giving the workstation heavy use.

Interior surfaces of the easel cart, the bottom, the shelves and braces are preferably finished with a low pressure laminate finish 82. Preferably vinyl bumpers 85 are applied to the nonlaminated cart surfaces so that smooth radiused edges are present for child safety purposes.

Figure 3:
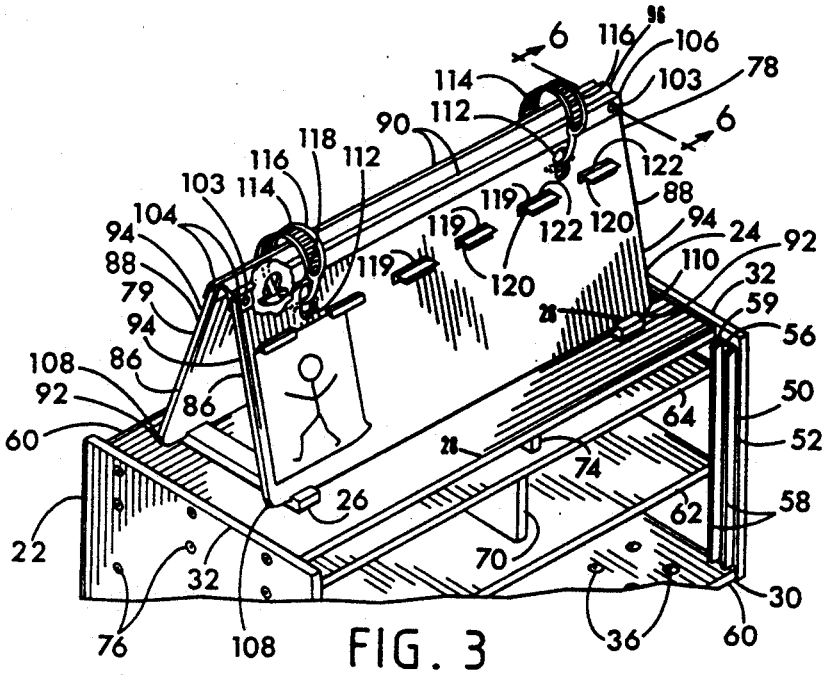
FIG. 3 is an isometric view of an easel erected on the top surface of the easel workstation of FIG. 1.

As best seen in FIG. 2, the two easel doors 24, when inserted within the U-shaped guides 52, form the side panels of the cart 22. Each of the easel doors 24 is a portable easel having two easel boards 78, 79. As best seen in FIGS. 3, 4 and 6, the easel boards 78, 79 are preferably made of particle board 80 having a high pressure laminate finish 81 on each of the two sides 83, 84 of the particle board 80. The easel boards 78, 79 are identical and each have an interior surface 86 and an exterior surface 88. The easel boards 78, 79 also have a top 90, a bottom 92 and two sides 94. As best seen in FIG. 6, the top 90 of the easel boards 78, 79 are joined by a flexible hinge strip 96 on both the interior surface 86 and exterior surface 88. The hinge strip 96 has two semi-rigid plastic gripper portions 98, 100 connected by a flexible plastic web 102. Each of the gripper portions 98, 100 engages the top 90 of an easel board 78. Flexible members 101 resiliently engage the board, and an adhesive further attaches the hinge strip 96 to the board 78. Preferably, plastic screw-on rivets 103 are attached through the gripper strip and easel boards 78, 79 at each top side corners 104, 106. The hinge strip 96 is preferably co-extruded with the gripper portions 98, 100 being formed of a generally rigid plastic and the web 102 and the flexible members 101 formed of a more resilient plastic material. The bottom side portions 108, 110 of each of the easel boards 78, 79 are preferably rounded to assist entry of the easel doors into the guides 50.

As best seen in FIGS. 1, 2 and 3, the easel boards 78, 79 further have slots 112 which penetrate through each of the easel boards 78, 79 and are parallel and opposite one another. The slots 112 may serve as handholds for removing the easel doors from the cart. However, flexible plastic handles are preferably inserted into the slots 112 of each easel board 78, 79. Each gripping handle 114 is a narrow rectangular ridged strip 116 of flexible plastic with a wider anchor 118 on each end of the strip 116. The anchors 118 are inserted into the slots 112 on each easel board 78 and are sufficiently wider than the narrow dimension of the slots to be retained when an upward lifting force is applied to the bent strip 116 of the handle 114. Two handles are used on each easel door 24 to facilitate two-handed lifting of the easel doors from the cart.

As best seen in FIG. 3, each easel board 78 also has a plurality of magnetic paper clamps 119 for attachment and fastening of art paper to the easel surface. Each clamp has a pair of magnetic strips 120 which are attached to a flexible plastic base 122. One of the magnetic strips 120 and the flexible plastic base 122 backing the strip 120 is fastened to a board exterior surface 88. The magnetic strips 120 are magnetically attractive such that when a piece of paper is inserted between the pairs of magnets, the paper is held securely by the magnets' attraction and fixed to the exterior surface 88 of an easel board 78. Preferably three pairs of clamps 119, two for each sheet, are placed on each of the exterior surfaces 88 of the easel boards 78, 79, allowing the easels to accommodate up to three children per easel board 78, 79 or six children per easel 24.

As best seen in FIG. 2, an easel door 24 may be stored on each side 60 of the cart 22. When inserted within the opposed guides 50 mounted to the cart side walls 32, the easel doors 24 close off the interior space of the cart and prevent access thereto. The stored easel doors 24 are substantially flush with the top 28 of the cart with the handles 114 extending upward for easy access thereto.

As best seen in FIG. 1, when the easels 24 are needed, the handles 114 are grasped and the easel doors 24 are removed by pulling upwardly and sliding the easel boards 78, 79 out of the guides 50. In order to fully remove an easel door 24, it must be lifted to a height approximately twice that of the cart itself as best seen in FIG. 1. Small children, because of their diminutive stature, will not have sufficient reach to remove the easel doors 24 and access the art and cleaning supplies stored within the cart. This barrier to access is particularly desirable in classroom use, thus keeping needed supervision of the carts 22 to a minimum. An easel door 24 can be removed and positioned on easel positioning blocks 26. The blocks 26 can be located on the easel cart top 28 as seen in FIG. 3 or on a table top (not shown). When the easel 24 is positioned on the easel cart 22, the casters 34 may be locked to provide a stable surface for use by children for painting. The other easel 24 may be left in place in the cart or may be positioned on a counter (not shown) or table top (not shown) for use. The two easels 24 can accommodate 8 to 12 children in a fairly compact space.

Figure 5:
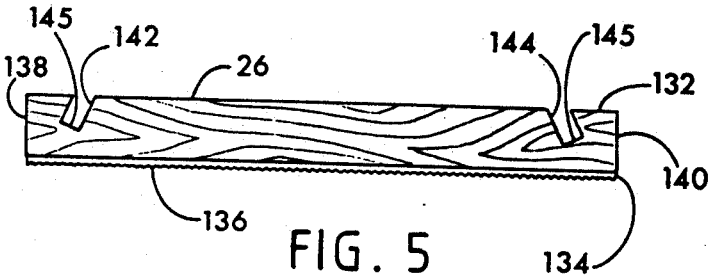
FIG. 5 is a elevational view of an easel positioning block of the easel workstation of FIG. 1.

As best seen in FIGS. 1, 3 and 5, the easel positioning blocks 26 provide a stable base for the erected easel doors 24 and retain the easel boards 78, 79 at the appropriate upright inclined angle for best use. The easel positioning blocks 26 are generally rectangular in shape, having an upper surface 132 and a lower surface 134. The lower surface 134 has a plurality of downwardly protruding ridges 136. The projecting ridges 136 serve as a nonskid surface. The upper surface 132 of each of the easel positioning blocks 26 has two grooves 142, 144 located towards the outside edges 138, 140. The grooves 142, 144 are parallel and inclined towards one another at the upper surface 132 at an angle of incline desired for the easel boards 78, 79. The grooves 142, 144 accommodate the easel boards 78, 79 in the open position. Each groove 142, 144 is a sloping, generally U-shaped kerf 145. For stability, two easel positioning blocks 26 are used with each easel door 24. The easel blocks are preferably made of wood with a plastic nonskid portion; however, other materials may be used. The easel positioning blocks 26 can easily be stored on any of the shelves or on the cart bottom when not in use.

Supply trays to hold water and other wet supplies may be used in conjunction with the erected easel doors. The cart top is thus wide enough to accommodate the erected easel door with space remaining on the sides of the easel boards for placement of such a tray.

It should be noted that storage for more than two easel doors may be provided on each cart by mounting more than one pair of channels on each side of the cart. Furthermore, two or more narrower easel doors may be provided along the length of each side. It should also be noted that the cart may be made without casters and used in a stationary fixed position.

It is understood that the invention is not confined to the particular construction and arrangement of parts herein illustrated and described, but embraces such modified forms thereof as come within the scope of the following claims.

We claim:

1. An easel workstation comprising:

a) a cart having two spaced side panels, a top panel and a bottom panel extending between the side panels, the top panel, the bottom panel and the side panels defining an interior space;

b) at lest one vertical channel extending along a vertical edge of each side panel, wherein a pair of vertical channels, one on each side panel oppose one another; and c) a portable easel which has two hinged boards which in an open configuration can be erected on a cart support surface such that the boards define inclined vertical work surfaces, and wherein in a closed configuration the hinged boards engage with the vertical channels to close off the interior space at the edges of the side panels on which the channels extend.

2. The easel workstation of claim 1 further comprising at least one handle extending from the easel to facilitate removal of the easel form the cart.

3. The easel workstation of claim 1 further comprising at least one easel positioning block, each block having downwardly protruding ridges for engagement with a support surface, and wherein portions of the block define upwardly opening inclined grooves which engage with the easel boards therein and which position the boards at a desired angle.

4. The easel workstation of claim 1 wherein one of the planar support surfaces comprises a cart bottom and wherein a plurality of caster wheels are attached to the cart bottom.

5. The easel workstation of claim 4 wherein at lest one caster wheel is selectively lockable to prevent rotation of said one wheel.

6. A portable easel cart assembly, comprising:

a) two planar stiff easel boards which in an open configuration serve as inclined work surfaces wherein each easel board has a slot to facilitate lifting of the easel;

b) a cart having two spaced generally vertical side panels and at lest one vertical channel on each side panel, wherein the channel of each side panel engages an edge of said easel boards in a collapsed generally vertical configuration;

c) a flexible plastic hinge connecting the two easel boards along an upper edge; and d) at least one easel positioning block located on the cart above the side panels, wherein the block has inclined grooves which engage the easel boards opposite the hinge, the grooves being inclined at a desired angle of incline of the easel boards, wherein one groove is inclined rearwardly to engage one board and another groove is inclined frontwardly to engage the other board.

7. The portable easel cart assembly of claim 6 further comprising a plastic handle engaged with the slot in each easel board and defining a graspable upwardly extending loop.

8. The portable easel cart assembly of claim 6 further comprising at least one magnetic paper clamp which has a flexible plastic backing which connects a pair of magnetic strips for fastening art paper to an easel board, wherein the flexible plastic backing is fastened to the easel board.

9. The portable easel cart assembly of claim 6 wherein the flexible plastic hinge further comprises two grippe portions, spaced from one another and joined by a flexible plastic web, wherein each of the gripper portions is fastened to an easel board.

10. A mobile easel workstation comprising:

a) a cart having a top, a bottom, four casters, each affixed to the bottom, two spaced side panel, each side panel being perpendicular to the top and to the bottom, the side panels having an interior and exterior surface, and easel door mounting guide affixed to the interior surface of each of the side panels and generally perpendicular to the bottom of the cart;

b) at least on portable easel positioning block, each block having downwardly protruding ridges for engagement with the cart top, and wherein portions of the block define upwardly opening inclined grooves;

c) a portable easel having two easel boards, the boards each having an exterior and an interior surface, a top, a bottom and two sides wherein each of the tops of the easel boards is joined by a flexible hinge strip on both the top interior and the top exterior surface, such that the boards, when in an open configuration, define an inclined vertical work surface when inserted into the grooves in the positioning block and wherein the boards of the easel in a closed configuration engage with the easel door mounting guide for storage of the easel in engagement with the cart.

11. The easel workstation of claim 10 wherein the cart further comprises a first shelf of holding are supplies which is parallel to the top and the bottom of the cart and perpendicular to the two side panel and wherein the first shelf has generally the same dimensions as the top and further comprising a shelf brace perpendicular to the top, the bottom, and the sides, and generally bisecting the sides of the cart.

12. The easel workstation of claim 11 wherein the cart further comprise a second shelf for holding art supplies which is parallel to the top, the first shelf and the bottom, the cart further having a first brace and a second brace; wherein the first brace is perpendicular to and connects the first shelf to the second shelf and the the second brace is perpendicular to and connects the second shelf to the top of the cart; and wherein the first and second braces are parallel to the sides of the cart, and wherein the first and second braces are generally in the same plane and bisect the first and second shelves; and wherein the second shelf has the same general dimensions as the top.

13. The easel workstation of claim 10 wherein the casters are locking casters.

14. The easel workstation of claim 10 wherein portions of each easel board define a slot closely spaced from the hinge to facilitate lifting of the easel and further comprising a plastic handle engage with the slot in each seal board and defining a graspable upwardly extending loop.

15. The easel workstation of claim 10 wherein the easel further comprises a fastener attached to each of the easel boards, the fastener further comprising a pair of magnetic paper clamps having a flexible plastic backing connecting a pair of magnetic strips wherein the flexible backing behind one of the pairs of the magnetic strips is fastened to the exterior surface of the easel board, the second magnetic strip being flexibly and releasably attached.

* * * * *